US009173483B2

(12) United States Patent
Koolhaas et al.

(10) Patent No.: US 9,173,483 B2
(45) Date of Patent: Nov. 3, 2015

(54) ARTICLE OF FURNITURE

(71) Applicants: Rem Koolhaas, Rotterdam (NL); Andrew Blair Hector, Red Hill, PA (US)

(72) Inventors: Rem Koolhaas, Rotterdam (NL); Andrew Blair Hector, Red Hill, PA (US)

(73) Assignee: Office for Metropolitan Architecture (O.M.A.) Stadebouq B.V., Rotterdam (NL)

( * ) Notice: Subject to any disclaimer, the term of this patent is extended or adjusted under 35 U.S.C. 154(b) by 0 days.

(21) Appl. No.: 14/253,186

(22) Filed: Apr. 15, 2014

(65) Prior Publication Data

US 2014/0311062 A1 Oct. 23, 2014

Related U.S. Application Data

(60) Provisional application No. 61/814,952, filed on Apr. 23, 2013.

(51) Int. Cl.
*A47B 11/00* (2006.01)
*A47B 13/08* (2006.01)

(52) U.S. Cl.
CPC ..... *A47B 13/081* (2013.01); *A47B 11/00* (2013.01)

(58) Field of Classification Search
CPC ..... A47B 13/081; A47B 11/00; A47B 9/18; A47B 17/065; A47B 87/0207
USPC ..... 16/357, 358; 108/91–94, 102, 103, 139, 108/140, 142, 22, 104; 248/186.2, 282.1, 248/349.1
See application file for complete search history.

(56) References Cited

U.S. PATENT DOCUMENTS

| | | | | | |
|---|---|---|---|---|---|
| 938,242 | A | * | 10/1909 | Johnston | 108/94 |
| 1,289,657 | A | * | 12/1918 | Cheney | 312/201 |
| 2,663,608 | A | * | 12/1953 | Schauer | 312/326 |
| 2,757,998 | A | | 8/1956 | Adler | |
| 2,981,313 | A | | 4/1961 | Odell | |
| 3,020,111 | A | | 2/1962 | Berliner | |
| 3,418,950 | A | | 12/1968 | Hubbell et al. | |
| 3,479,632 | A | * | 11/1969 | Galles | 439/10 |
| 3,908,565 | A | * | 9/1975 | Burnett | 108/147 |
| 4,069,769 | A | | 1/1978 | Abrams | |
| 4,180,298 | A | | 12/1979 | Borgerson, Jr. | |
| 4,949,650 | A | | 8/1990 | Allard | |

(Continued)

FOREIGN PATENT DOCUMENTS

| | | |
|---|---|---|
| EP | 1785057 A1 | 5/2007 |
| EP | 1787547 A1 | 5/2007 |

OTHER PUBLICATIONS

International Search Report for PCT/US2014/034499 dated Jun. 26, 2014.

(Continued)

*Primary Examiner* — Janet M Wilkens
(74) *Attorney, Agent, or Firm* — Buchanan Ingersoll & Rooney PC

(57) ABSTRACT

An article of furniture includes a base, an intermediate member positioned above the base, a top member positioned above the intermediate member, and an adjustability mechanism that is attached to the base, the intermediate member, and the top member such that the intermediate member and the top member are each moveable relative to the base and such that the intermediate member is moveable relative to the top member and the top member is moveable relative to the intermediate member.

20 Claims, 7 Drawing Sheets

(56) References Cited

U.S. PATENT DOCUMENTS

| | | | | | |
|---|---|---|---|---|---|
| 5,138,955 | A | | 8/1992 | Manner | |
| 5,157,891 | A | | 10/1992 | Nelson | |
| 5,209,446 | A | * | 5/1993 | Kawai | 248/183.2 |
| 5,255,967 | A | | 10/1993 | Williams | |
| 5,370,255 | A | * | 12/1994 | Yang | 220/4.27 |
| 5,425,313 | A | * | 6/1995 | Rowan | 108/65 |
| 5,460,059 | A | * | 10/1995 | Kato | 74/89.22 |
| 5,460,105 | A | * | 10/1995 | Given, Jr. | 108/137 |
| 5,481,936 | A | * | 1/1996 | Yanagisawa | 74/490.08 |
| 5,503,086 | A | | 4/1996 | Hoffman et al. | |
| 5,562,049 | A | * | 10/1996 | Hoffman et al. | 108/94 |
| 5,611,762 | A | | 3/1997 | Kaye | |
| 5,937,764 | A | * | 8/1999 | Olivier | 108/20 |
| 6,045,193 | A | | 4/2000 | Johnson | |
| 6,199,490 | B1 | * | 3/2001 | Langer | 108/143 |
| 6,452,143 | B1 | * | 9/2002 | Choi | 219/753 |
| 6,454,683 | B1 | | 9/2002 | Kaye | |
| 7,469,642 | B1 | | 12/2008 | LeDoux | |
| 8,277,070 | B1 | | 10/2012 | Schwartz | |
| 8,708,168 | B2 | * | 4/2014 | Lin | 211/131.1 |
| 2008/0295449 | A1 | | 12/2008 | Fisher | |
| 2010/0146736 | A1 | * | 6/2010 | Oshima et al. | 16/354 |
| 2010/0319588 | A1 | * | 12/2010 | Hanna et al. | 108/20 |
| 2011/0219988 | A1 | | 9/2011 | Stephens | |
| 2012/0199051 | A1 | * | 8/2012 | Edinger et al. | 108/139 |
| 2012/0298017 | A1 | | 11/2012 | Chen | |

OTHER PUBLICATIONS

Written Opinion of the International Searching Authority for PCT/US2014/034499 dated Jun. 26, 2014.

* cited by examiner

ARTICLE OF FURNITURE

CROSS-REFERENCE TO RELATED APPLICATIONS

The present application claims priority to U.S. Provisional Patent Application No. 61/814,952, which was filed on Apr. 23, 2013.

FIELD OF INVENTION

The present invention relates to furniture, and more particularly, to coffee tables, counters, and other articles of furniture. An example of a coffee table may be a piece of furniture that has a horizontal work surface or upper surface, which may be referred to as a tabletop, that is supported by a base. Some coffee tables may also have multiple drawers or shelves in which items may be stored below the tabletop.

BACKGROUND OF THE INVENTION

Articles of furniture such as coffee tables or counters often have an upper surface on which a person may work or place things. Examples of coffee tables and counters may be appreciated from U.S. Pat. Nos. 8,277,070, 7,469,642, 6,454,683, 6,045,193, 5,611,762, 5,503,086, 5,255,967, 5,157,891, 5,138,955, 4,949,650, 4,180,298, 4,069,769, 3,418,950, 3,020,111, 2,981,313, 2,757,998, and U.S. Pat. App. Pub. No. 2008/0295449.

Counters and coffee tables often have a fixed position or are configured to be utilized in only one configuration. Such a design fails to permit the article of furniture to be used in different ways to accommodate different desired uses for the article of furniture. Such designs also fail to permit counters and coffee tables to be adjusted to provide different aesthetic effects.

We have determined that a new design is needed that permits a counter or coffee table to be adjustable so that a user may utilize the counter in different ways or reposition the counter to provide different aesthetic effects. In one embodiment, the article of furniture may also have drawers or support shelves to store items dishes, papers, office supplies, or other materials.

SUMMARY OF THE INVENTION

An article of furniture may include a base, an intermediate member positioned above the base, and a top member positioned above the intermediate member. The article may also include an adjustability mechanism that is attached to the base, the intermediate member, and the top member such that the intermediate member and the top member are each moveable relative to the base and such that the intermediate member is moveable relative to the top member and the top member is moveable relative to the intermediate member.

The adjustability mechanism may be connected to at least one of the intermediate member and the top member such that movement of the top member is independent of movement of the intermediate member. In some embodiments, the adjustability mechanism may comprise a first post and a second post. The first post can be attached to the base and extends into at least one first aperture of the intermediate member. The first post and the at least one first aperture of the intermediate member may define a path of movement along which the intermediate member is moveable relative to the base. The second post may be attached to the intermediate member and extend into at least one second aperture of the top member.

The second post and the at least one second aperture of the top member can define a path of movement along which the top member is moveable relative to the intermediate member. For some embodiments, the at least one first aperture can be comprised of a plurality of slots and the at least one second aperture can be comprised of a plurality of slots. In other embodiments, the at least one first aperture may be a single aperture and the at least one second aperture may be a single aperture. For certain embodiments, the adjustability mechanism may also include a first friction inducing member and a second friction inducing member. The first friction inducing member can be attached to the first post and contact a portion of the intermediate member adjacent the at least one first aperture such that the first friction inducing member induces friction when the intermediate member moves relative to the base. The second friction inducing member may be attached to the second post and contact a portion of the top member adjacent the at least one second aperture such that the second friction inducing member induces friction when the top member moves relative to the base.

In other embodiments, the adjustability mechanism may only include a first post. The first post may be attached to the base and extend through at least one first aperture of the intermediate member and into at least one second aperture of the top member. The first post and the at least one first aperture of the intermediate member can define a path of movement along which the intermediate member is moveable relative to the base. The first post and the at least one second aperture of the top member may define a path of movement along which the top member is moveable relative to the intermediate member. The adjustability mechanism may also be comprised of a first friction inducing member and a second friction inducing member. The first friction inducing member can be attached to the first post and contact a portion of the intermediate member adjacent the at least one first aperture such that the first friction inducing member induces friction when the intermediate member moves relative to the base. The second friction inducing member may be attached to the first post and contact a portion of the top member adjacent the at least one second aperture such that the second friction inducing member induces friction when the top member moves relative to the base.

In some embodiments, the top member may slide along a top surface of the intermediate member when the top member is moved and the intermediate member can slide along a top surface of the base when the intermediate member is moved. Such sliding may include the top member directly contacting the intermediate member when it is slid along the intermediate member and the intermediate member directly contacting the base when it is slid along the base. In other embodiments, the top member is spaced apart from the intermediate member by a first gap and the intermediate member is spaced apart from the base by a second gap.

Other embodiments of the article of furniture comprise a base, an intermediate member positioned above the base, a top member positioned above the intermediate member, and an adjustability mechanism. The adjustability mechanism may be comprised of a first post and a second post. The first post may be attached to the base and extend into at least one first aperture of the intermediate member. The first post and the at least one first aperture of the intermediate member may define a path of movement along which the intermediate member is moveable relative to the base. The second post may be attached to the intermediate member and extend into at least one second aperture of the top member. The second post and the at least one second aperture of the top member may define a path of movement along which the top member is moveable relative to the intermediate member.

In some embodiments, the at least one first aperture is comprised of a plurality of slots and the at least one second aperture is comprised of a plurality of slots. The slots may be positioned above other slots in each of the intermediate member and the top member.

The adjustability mechanism may also be comprised of a first friction inducing member and a second friction inducing member. The first friction inducing member may be attached to the first post and contact a portion of the intermediate member adjacent the at least one first aperture such that the first friction inducing member induces friction when the intermediate member moves relative to the base. The second friction inducing member may be attached to the second post and contact a portion of the top member adjacent the at least one second aperture such that the second friction inducing member induces friction when the top member moves relative to the base.

Embodiments of the article of furniture can be configured to include an adjustability mechanism that comprises a first rotatable plate attached to the first post and a first rail that is movable linearly within the intermediate member relative to the first rotatable plate, a second rotatable plate attached to the second post; and a second rail that is moveable linearly within the top member relative to the second rotatable plate. The adjustability mechanism can also comprise a first guide member that is positionable into the first rail and a first detent mechanism that is attached to the first guide member to releaseably lock the first rail to the first guide member as well as a second guide member that is positionable into the second rail and a second detent mechanism that is attached to the second guide member to releaseably lock the first rail to the first guide member. The adjustability mechanism can additionally include at least one first dampening mechanism attached to the first rotatable plate, at least one second dampening mechanism attached to the first rail, at least one third dampening mechanism attached to the second rotatable plate, and at least one fourth dampening mechanism attached to the second rail.

Embodiments of the article of furniture may be configured as different pieces of furniture. For instance, the article may be configured as a coffee table, a counter, or an end table.

In some embodiments of the article of furniture, the top member and intermediate member are moveable to move the article of furniture into a plurality of different orientations in which the intermediate member and the top member are offset and in which the base and the intermediate member is offset. Additionally, the top and intermediate members may be moved into an orientation in which the top member fully covers the intermediate member and the base so that only the top of the top member provides an upper surface of the article when the article is in that orientation. In yet other orientations, portions of a top surface of the base and intermediate member may be uncovered by the top member and intermediate member so that the upper surface of the article may include portions of the top surface of the intermediate member and base member that are uncovered as well as the top surface of the top member.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of the article of furniture are shown in the accompanying drawings. It should be appreciated that like reference numbers used in the drawings may identify like components.

DETAILED DESCRIPTION OF EXEMPLARY EMBODIMENTS

An article of furniture 1 may be configured as a coffee table. Alternatively, it is contemplated that the article of furniture 1 may be configured as a counter or as an end table.

The article of furniture 1 may include a base 2 that is attached to an intermediate member 4 such that the intermediate member 4 is moveable relative to the base 2. The intermediate member 4 may be moveably attached to a top member 6 so that the top member is moveable relative to the base 2 and the intermediate member 4. The top surface of the top member 6 may define a tabletop of the article of furniture.

Figure 1:
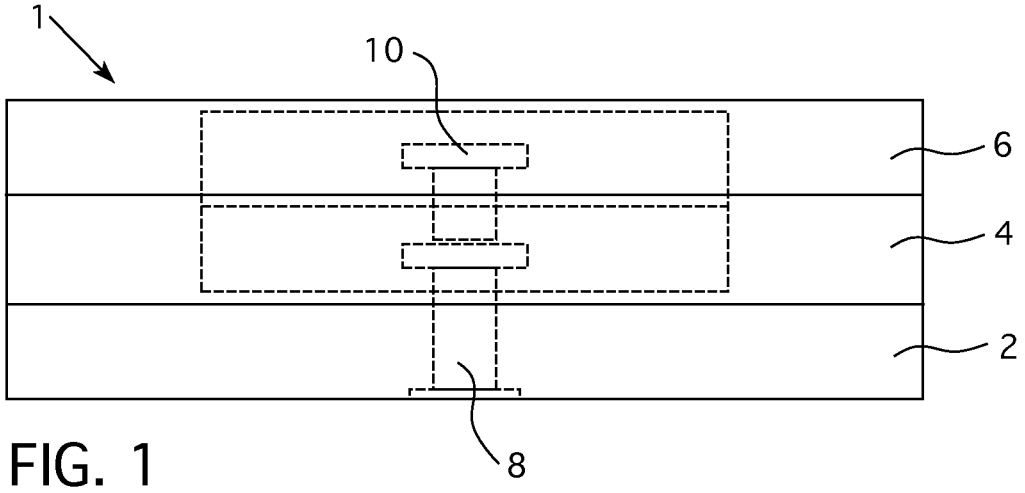
FIG. 1 is a front view of a first exemplary embodiment of a coffee table in a first orientation. An adjustability mechanism for movement of different portions of the coffee table is shown in broken line in FIG. 1.
Figure 2:
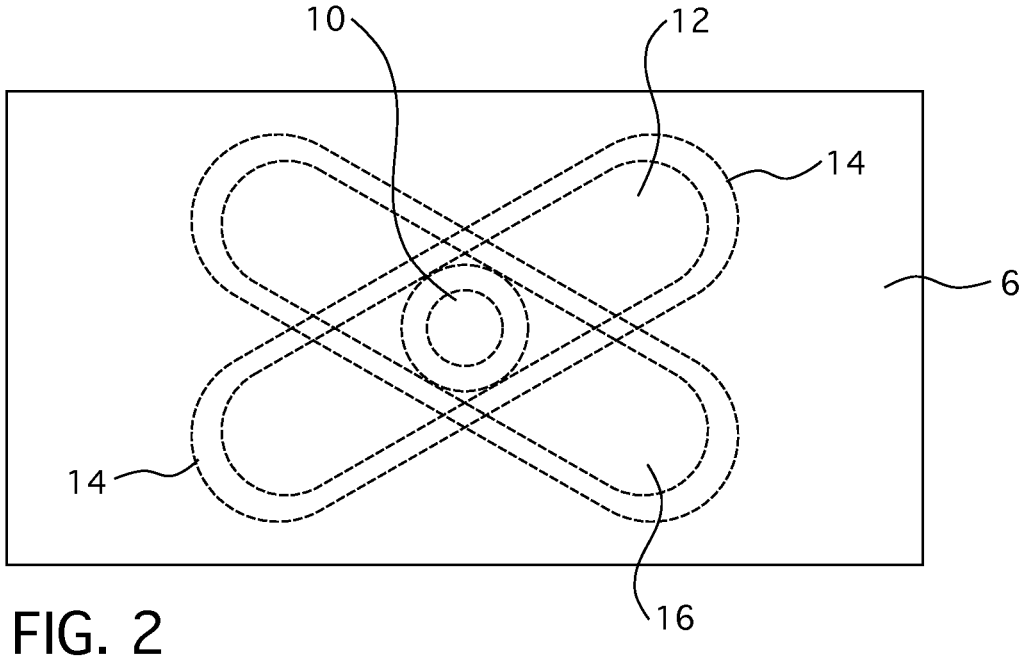
FIG. 2 is a top view of the first exemplary embodiment of the coffee table in the first orientation. An adjustability mechanism is shown in broken line in FIG. 2.
Figure 3:
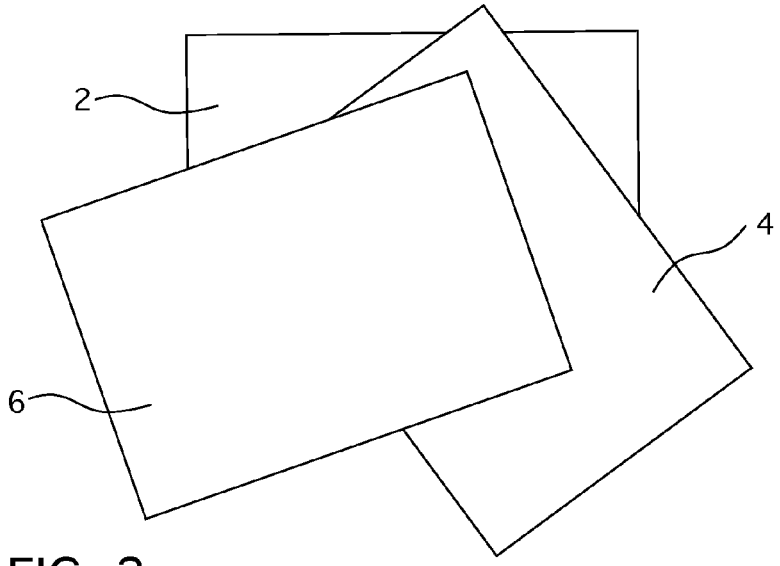
FIG. 3 is a top view of the first exemplary embodiment of the coffee table in a second orientation.
Figure 4:
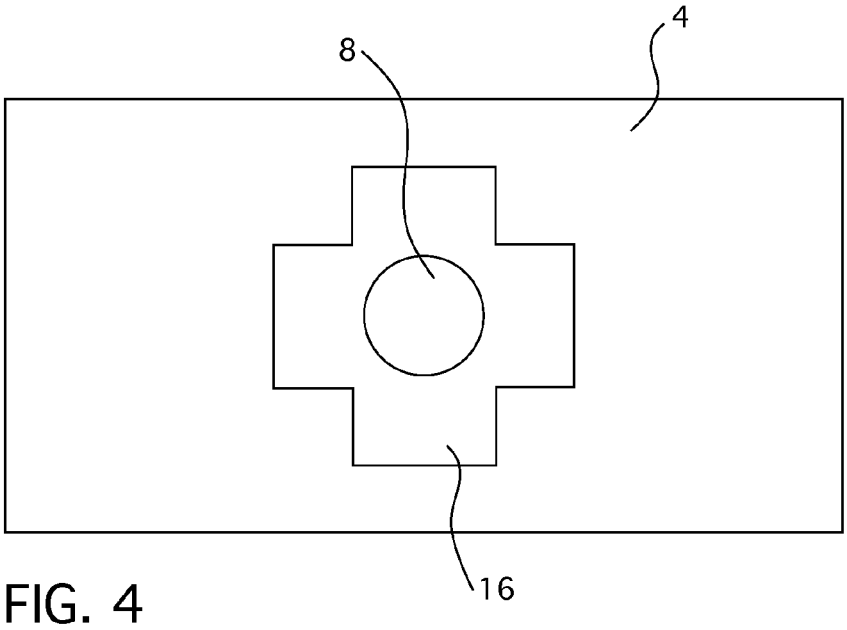
FIG. 4 is a top view of an exemplary embodiment of the coffee table in a first orientation with a portion of the top member removed and a portion of the adjustability mechanism for adjusting a position of the top member being removed to illustrate a portion of an embodiment of an adjustability mechanism utilized for adjustment of an intermediate member of the coffee table.
Figure 5:
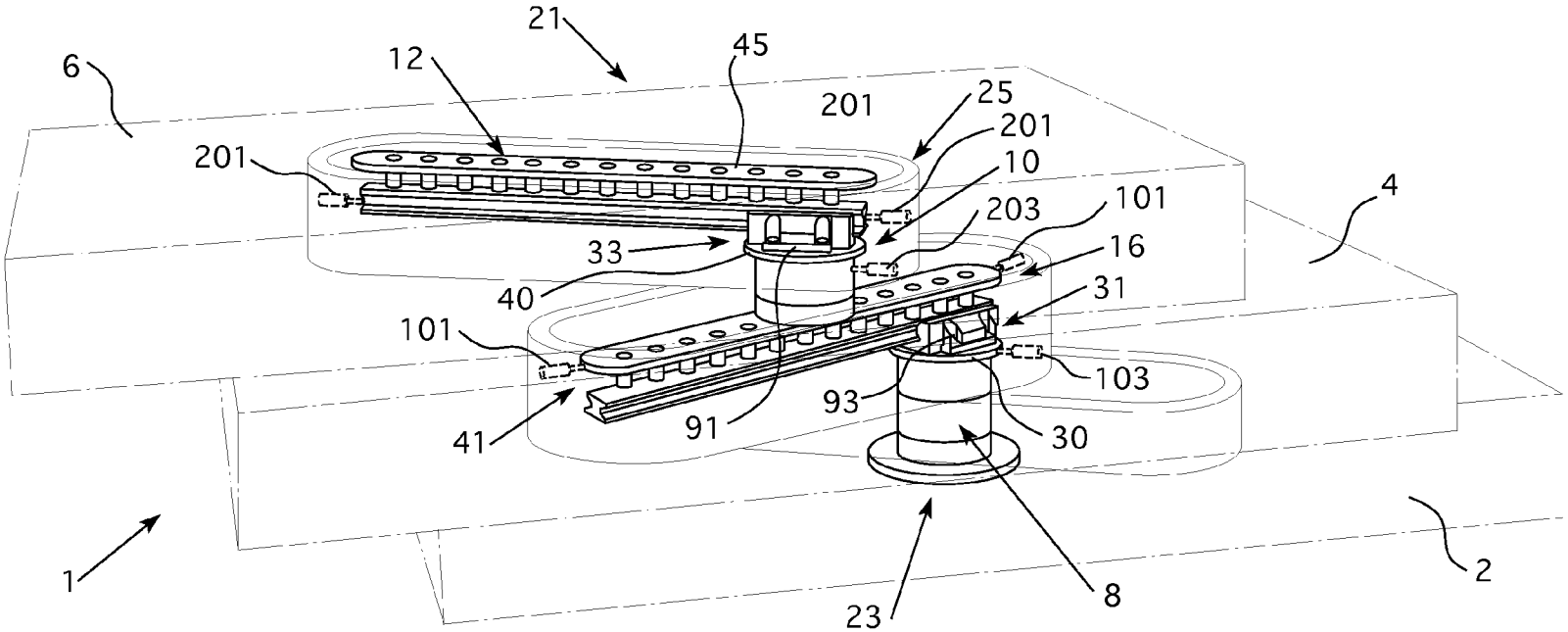
FIG. 5 is a side perspective view of the first exemplary embodiment of the coffee table in a third orientation. The outer surfaces of the top, intermediate and base members are shown in broken line to more clearly illustrate an adjustment mechanism assembly positioned within the article of furniture. Dampening mechanisms 101, 103, 201 and 203 that are utilizable in the coffee table are shown in broken line in FIG. 5.
Figure 6:
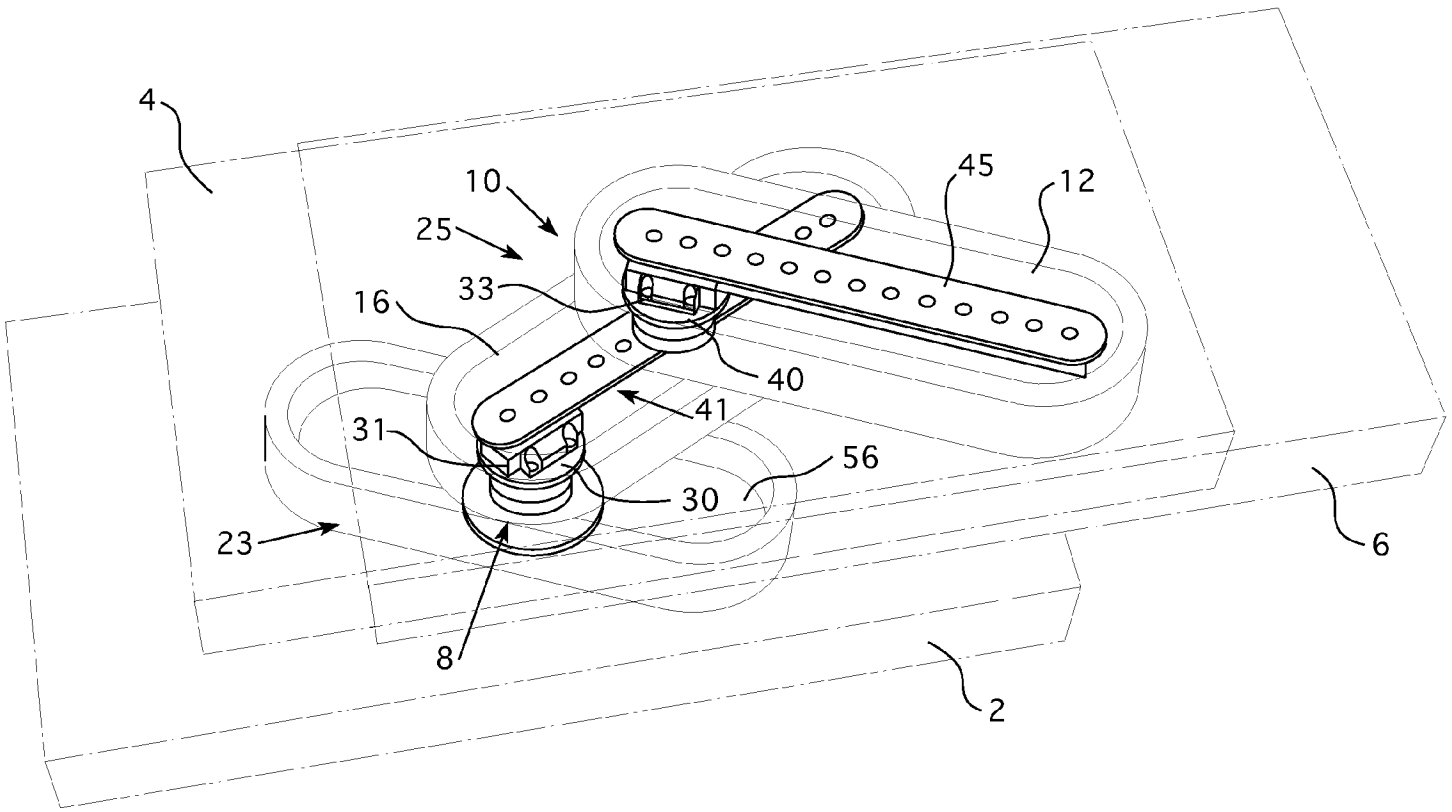
FIG. 6 is an elevated perspective view of the first exemplary embodiment of the coffee table in the third orientation. The outer surfaces of the top, intermediate and base members are shown in broken line to more clearly illustrate an adjustment mechanism assembly positioned within the article of furniture.
Figure 7:
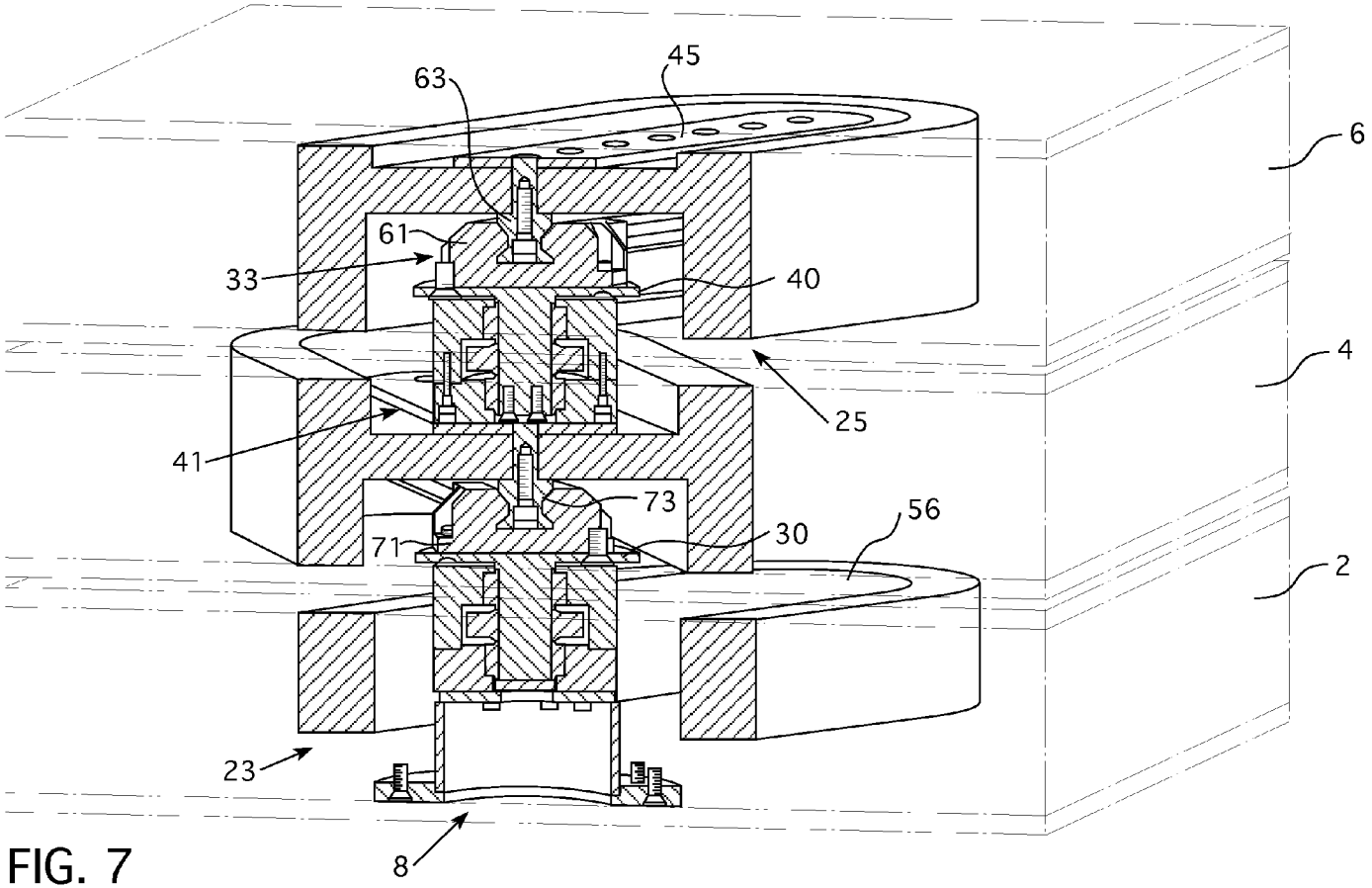
FIG. 7 is a first cross sectional view of the first exemplary embodiment of the coffee table in the third orientation to illustrate an embodiment of the adjustability mechanism of the coffee table. The outer surfaces of the top, intermediate and base members are shown in broken line to more clearly illustrate an adjustment mechanism assembly positioned within the article of furniture.
Figure 8:
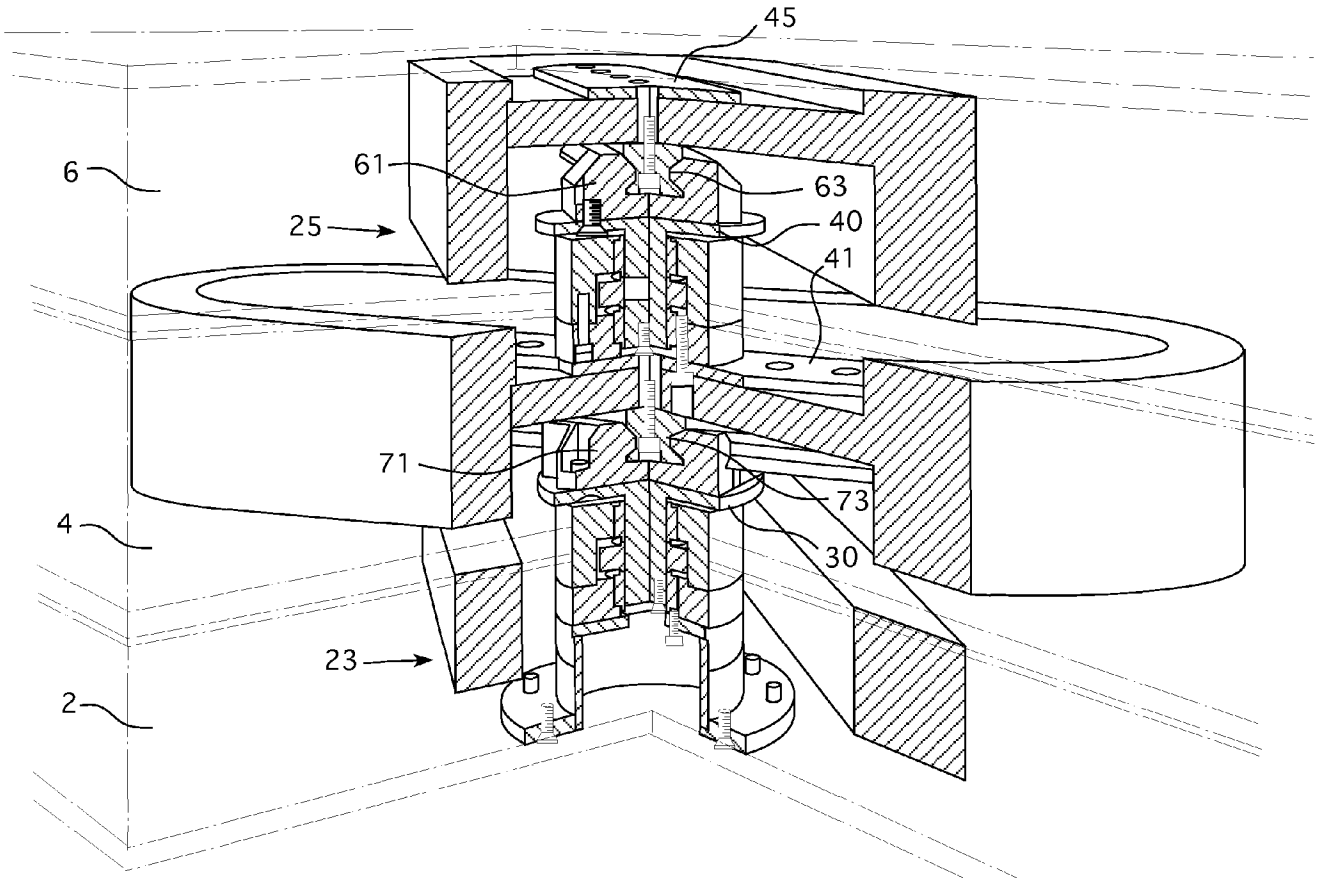
FIG. 8 is a second cross sectional view of the first exemplary embodiment of the coffee table in the third orientation to illustrate an embodiment of the adjustability mechanism of the coffee table. The outer surfaces of the top, intermediate and base members are shown in broken line to more clearly illustrate an adjustment mechanism assembly positioned within the article of furniture.
Figure 9:
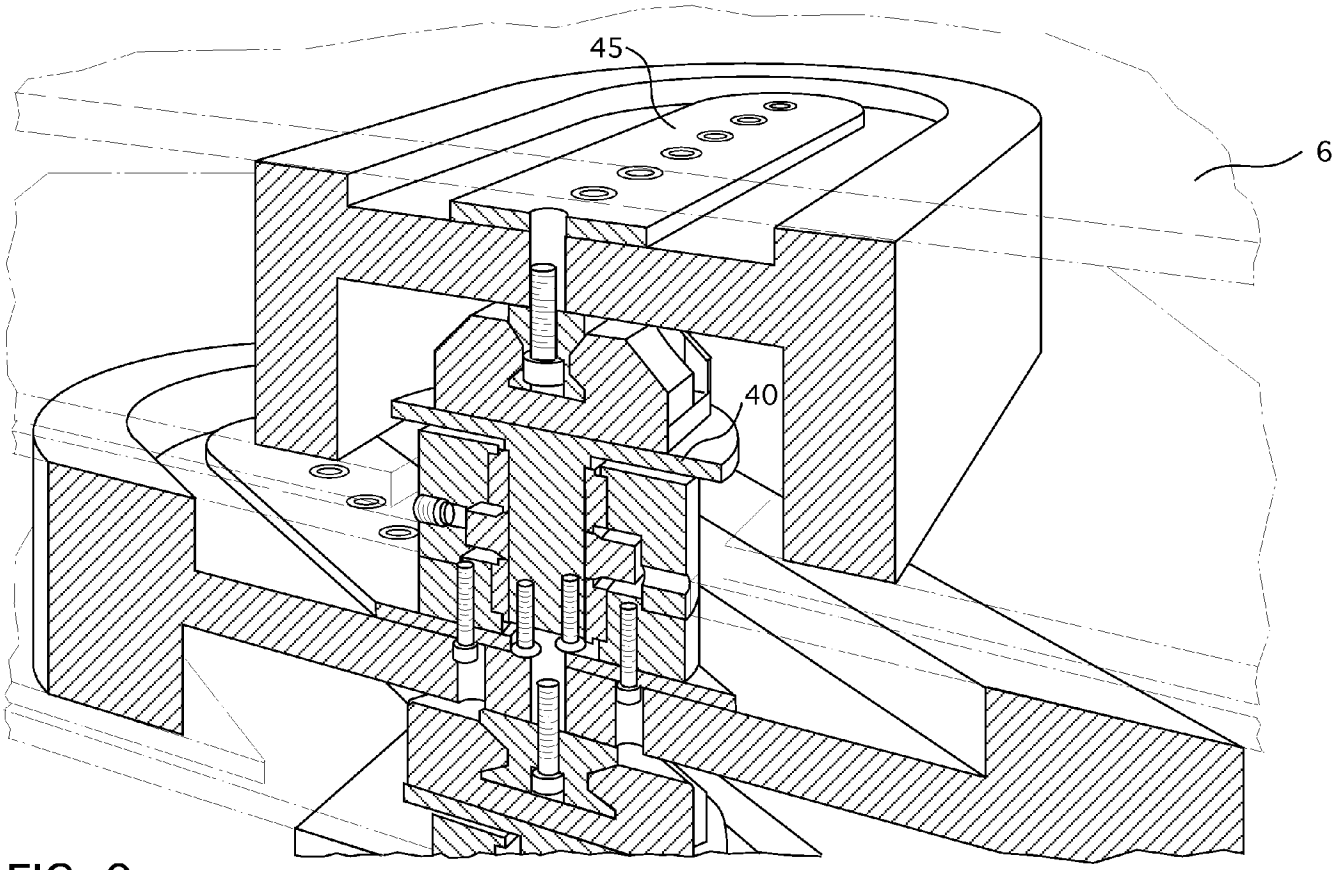
FIG. 9 is an enlarged fragmentary cross sectional view of the first exemplary embodiment of the coffee table in the third orientation to illustrate an embodiment of the adjustability mechanism of the coffee table. The outer surfaces of the top, intermediate and base members are shown in broken line to more clearly illustrate an adjustment mechanism assembly positioned within the article of furniture.

An adjustability mechanism may be included within the article of furniture 1 to facilitate adjustment of the intermediate member 4 and top member 6 so that the article of furniture 1 may be placed in different orientations to alter the aesthetic effect provided by the article of furniture 1. For instance, the intermediate member 4 and top member 6 may each be moved to adjust the orientation of the article of furniture from a first orientation as shown in FIG. 1 to a second orientation as may be appreciated from FIG. 3.

It should be understood that the adjustability mechanism may permit the article of furniture to be placed in a number of other orientations by moving the intermediate member 4 and top member 6 relative to each other and also relative to the base 2. In one orientation, the top member 2 may be arranged to fully cover the intermediate member 4 and base 2. In such an orientation, the top surface of only the top member 6 may function as a tabletop or provide a surface on which an object such as a glass, plate, or paper may be placed or supported. In other orientations, the intermediate member 4 and top member 6 may be moved so that the top surfaces of the top member 6, intermediate member 4 and base 2 at least partially offset as may be appreciated form FIG. 3. In such an offset orientation, at least a portion of the top surface of the intermediate member 4 and a portion of the top surface of the base 2 may be exposed so that an object such as a glass or plate may be supported or rested upon that portion of the upper surface of the article of furniture 1. In yet other orientations, the upper surface of only the intermediate member and top member may be exposed. In such an orientation, the intermediate member 4 may fully cover the base 2 so that the top surface of the base is not exposed. In such an orientation, only the intermediate member 4 and top member 6 may be offset.

In some embodiments, the adjustability mechanism may be configured so that the intermediate member 4 may be moved independently of the top member 6 and the top member 6 may be moved independently of the intermediate member 4. In other embodiments, the adjustability mechanism may be configured so that movement of the intermediate member 4 may also cause the top member 6 to move or so that movement of the top member 6 may also cause the intermediate member 4 to move.

The adjustability mechanism may include a first post 8 that is within the base 2 and extends to the intermediate member 4. The adjustability may also include a second post 10 that extends from the intermediate member 4 to the top member 6. The first post 8 may have a top portion that is positionable within a first aperture 16 defined within the intermediate member 4. The first aperture 16 may be an elongated opening such as a slot or oval shaped opening. Alternatively, the first aperture 16 may be a cross shaped opening or other polygonal shaped or curved shaped opening that has more than two end points. The first aperture 16 may define the extent to which the intermediate member 4 is moveable relative to the base 2. The first post 8 contacts part of the intermediate member that defines a side of the first aperture 16 when the intermediate member is moved to a particular position to prevent further movement of the intermediate member 4 in a given direction. The first aperture 16 may therefor define a path of movement or path of adjustability of the intermediate member 4 relative to the base.

The first post 8 may include or be attached to a first plate that is configured to engage a portion of the intermediate member above or below the first aperture 16. The first plate may slide along an inner portion of the intermediate member 4 that defines the first aperture 16. The first plate may be configured to provide a predetermined amount of friction during movement of the intermediate member 4 to permit the intermediate member 4 to be maintained in a given position after being moved until a certain predefined amount of force is exerted on the intermediate member to cause it to move. Such friction inducement can prevent the intermediate member 4 from being freely moved by accidental touching or by accidental contact by a person near the article of furniture.

A second post 10 may have a lower portion attached to the intermediate member 4 and a top portion that extends into the top member 6 and through a second aperture 12. The second aperture 12 may include multiple ends 14. The post 10 may engage sidewalls that define any of the ends 14 to define a path of travel or movement of the top member 6. The second post 10 may be attached to a second plate that is positioned over the second aperture 12 and slides along an inner portion of the top member 6 that is directly above or below the second aperture 12 formed in or defined in the top member 6. The second plate may be configured to provide a predetermined amount of friction to permit the top member 6 to be maintained in a given position after being moved until a certain predefined amount of force is exerted on the top member 6 to cause it to move. Such friction inducement can prevent the top member 6 from being freely moved by accidental touching or by accidental contact by a person near the article of furniture.

In some alternative embodiments of the article of furniture, first and second apertures 16, 12 may each be replaced with multiple overlapping slots formed immediately above each other within a particular member. For instance, the intermediate member 4, the top member 6, or both the intermediate member 4 and top member 6 may have multiple slots within one slot being positioned above at least one other slot. A post that extends through all the slots may then engage portions of the member to define a path of adjustability for that member. For instance, the slots and post may then define an extent to which the member is moveable as the post will engage a sidewall defining at least one of the slots to prevent further movement of the member beyond a particular position.

In other embodiments of the article of furniture 1, it is contemplated that there may be an adjustability mechanism that utilizes two or more first posts and two or more second posts. The two or more first posts for example may each pass through the same aperture such as a first aperture 16 or may each pass through one or more slots defined in the intermediate member. The two or more second posts may pass through the same aperture such as the second aperture 12 formed in the top member 6 or may pass through multiple slots formed in the top member. In some embodiments, the first posts will pass through the same slots or aperture of the intermediate member and the second posts will pass through the same slots or apertures of the top member. In other embodiments, the first posts may pass through different slots or different apertures of the intermediate member and the second post may pass through different slots or apertures of the top member.

In yet other embodiments of the article of furniture, it is contemplated that the adjustability mechanism may only include a single post that extends from within the base 2 to the top member 6. It should be understood that single post would also pass through the intermediate member 4 in such an alternative embodiment. The single post may pass through one or more apertures in each of the top and intermediate members to define an extent to which each member may be moved. One or more plates may be attached to the post adjacent at least one aperture in each member to provide a friction inducing mechanism to require a predetermined level of force to be exerted on each member to move that member to a new position. The friction inducing mechanism may help prevent accidental movements of each member and help maintain to selected position of the article of furniture or a particular member of the article of furniture.

The base 2, top member 6 and intermediate member 4 may include a housing that surrounds the adjustability mechanism or a portion of the adjustability mechanism. The base 2, intermediate member 4, and top member 6 may each have a housing that is polygonal shaped and has a flat top surface that may support an object such as a dish, a glass, a magazine, or office supplies so that different portions of the top surface of the intermediate member 4 or base 2 are exposed in certain orientations of the article of furniture, those exposed portions of the top surfaces of the base 2 and intermediate member 4 may provide a functional support surface in addition to contributing to the aesthetic effect of the article of furniture.

To facilitate movement of the intermediate and top members 4 and 6, the base 2 and intermediate member 4 may be spaced apart from each other by a relatively small gap. A relatively small gap may also space apart the top member 6 from the intermediate member 4. Alternatively, the bottom surface of the top member 6 may slide along the top surface of the intermediate member 4 when the top member is moved and the bottom surface of the intermediate member 4 may slide along the top surface of the base 2 when the intermediate member 4 is moved.

Referring to FIGS. 5-9, an embodiment of the adjustability mechanism that may be included within the first exemplary embodiment of the coffee table or other embodiment of an article of furniture is discussed more fully below. It should be appreciated that the adjustability mechanism of the coffee table or other article of furniture may utilize one or more sliding mechanisms, one or more rotational mechanisms and one or more detent mechanisms for facilitating adjustment of different members. For instance, in some embodiments, the adjustability mechanism may include multiple sliding mechanisms, multiple rotational mechanisms and multiple detent mechanisms. It should be understood that infinite position locks or friction inducement based mechanisms may be used to maintain a position of a top member or intermediate member instead of a detent mechanism in some alternative embodiments.

As may be appreciated from FIGS. 5-9, the adjustability mechanism 21 may include a first attachment mechanism 23 for moveably attaching the intermediate member 4 to the base 2 and a second attachment mechanism 25 for moveably attaching the top member 2 to the intermediate member 4.

The first attachment mechanism may include the first post 8 that extends from the base 2 to the intermediate member 4. The first post 8 may have a first rotatable plate 30 or other rotatable member attached thereto. The first rotatable plate 30 may be attached to a first slideability mechanism 31. The first slideability mechanism 31 may include a first guide member 71, or first carriage that has a first aperture 73 that is sized and shaped to receive a first rail 41 positioned in the intermediate member. The first rail 41 may be slid through the first aperture 73 while the first guide member 71 does not move to provide a sliding movement to permit linear movement of the intermediate member relative to the base. Alternatively, the guide member 71 may slide along the first rail 41.

A first detent mechanism 93 may be attached to the first guide member 71 and be configured to releasably lock the first rail 41 to the first guide member 71. An actuator such as a button, lever, or knob may be attached to the intermediate member 4, base 2, or top member 6 and be coupled to the first detent mechanism 93 to cause a detent member of the detent mechanism to move to an unlocked position so that the intermediate member may be moved linearly to a new position. A plurality of holes may be formed on the rail 41 to define different positions along which the intermediate member may be moved linearly. In other embodiments, no detent mechanism may be provided and the linear position of the intermediate position may be maintained via a predetermined level of friction that may be induced between the first rail 41 and the first guide member 71 that requires force from a user to be provided to cause linear movement of the intermediate member 4 via movement of the first rail 41 through the first aperture 73. As yet another alternative, an infinite position lock mechanism may be utilized to maintain a position of the intermediate member instead of a detent mechanism.

The first rotatable plate 30 attached to the first post 8 may be rotatable about 360° or less than 360° such as a 180° or 90° extent of rotational travel. The plate may be rotatable in both clockwise and counter clockwise directions about the extent of its rotational travel. A detent mechanism may be configured to define the extent to which the first rotatable plate 30 is rotatable or to releaseably lock the first rotatable plate into a user selected position. If a detent mechanism is included, an actuator that a user may manipulate to control the locking or unlocking of a detent member may be attached to the coffee table and to a detent member of the detent mechanism to move the detent member into an unlocked position for rotating the intermediate member via the first rotatable plate 30. A structure such as a portion of the intermediate member or a portion of the first rotatable plate 30 may have one or more openings sized to receive the moveable detent member for releasably locking the position of the rotatable plate. The detent member may be connected to the other of a structure of the intermediate member or portion of the rotatable plate. The openings that may define different positions in which the intermediate member 4 may be releasably locked in may be defined by the arrangement of the openings. The openings may be spaced 5-10° apart or up to 20°, 30°, 45° or 60° apart along a path of travel that extends 90°, 180° or 360° for example.

The detent member may be connected to a spring to bias the detent member to a locked position. The spring to which the detent member is connected may be positioned between an actuator and the detent member.

As an alternative to a detent mechanism for preventing undesired rotation of the intermediate member 4, a locking device or an infinite position locking device may be utilized to prevent undesired rotation of the intermediate member. A locking device may lock the position by preventing rotation of the first rotatable plate 30 unless the locking device is adjusted to an unlocked position. As another alternative, the first rotatable plate 30 may be attached to the first post 8 such that a relatively high force is needed to be provided by a user to effect rotation due to friction that is induced by components attached to the first post 8 and that contact the first rotatable plate that induce friction that must be overcome to drive rotation of the first rotatable plate 30.

Dampening mechanisms may also be connected to the first slide mechanism 31 and first rotatable plate 30 to ensure a force above a predetermined amount of force is needed to be applied to cause sliding or rotation of the intermediate member and also ensure that the movement of the intermediate member occurs within a predetermined rate of speed to avoid both accidental movement of the intermediate member 4 and instability that can occur from high speeds of movement of the intermediate member. Instability may be caused by a high speed of the intermediate member that could cause an object supported by the intermediate member 4 or top member 6 to fall over or to cause the base 2 of the coffee table to move in an undesired way (e.g. tilt or slide along a floor when a user does not intend for this to occur, etc.).

At least one first dampening mechanism 103 may be connected to the first rotatable plate 30 and be configured to regulate the speed at which the rotatable plate may rotate. A plurality of dashpots may be connected to the rotatable plate to provide such dampening. For instance, a first dashpot may have an extendable arm or base pivotally connected to the base 2 or intermediate member adjacent a first side of the rotatable plate and a second dashpot may have its extendable arm or receptacle member pivotally connected to the base 2 or intermediate member 4 on a second side of the rotatable plate that is opposite the first dashpot. A respective gear, a respective gear of a plurality of intermeshed gears, or a connector that may rotate when the first rotatable plate 30 rotates may be attached or immovably affixed to each dashpot so that rotation of the first rotatable plate causes the extendable arm of the dashpot to extend or retract via the coupling of the dashpot to the first rotatable plate 30. The gear or connector to which each dashpot is connected may be configured to rotate at a different ratio than the first rotatable plate 30 to cause extension and retraction of the dashpots to occur at a desired rate that corresponds to rotation of the first rotatable plate 30.

The size, strength, and force exerted by the dashpots may be configured to define a desired level of force needed to rotate the intermediate member 4 and also ensure that rotation of the intermediate member only occurs within a preselected rate of rotation. In other embodiments, linear dampers, hydraulic dampers, gas dampers, or other damper elements may be utilized instead of dashpots.

At least one second dampening mechanism 101 may be connected to the first rail 41 to help regulate the speed at which the intermediate member may be moved. The second dampening mechanism may include a looped chain or cable that extends between two pulleys at a given level of tension such that movement of the first rail 41 causes the looped chain or cable to move. The friction or force provided via the looped chain may prevent sliding of the first rail 41 to occur at an undesired rate of speed. At least one rotary damper or at least one dashpot may be connected to at least one of the pulleys to help define the dampening provided via the rotatable chair or cable. Alternatively, dashpots or other linear dampers may be coupled to opposite ends of the first rail 41 so that sliding of the rail in one direction within the first aperture 16 causes one dashpot's moveable arm to extend and the other dashpot's moveable arm to retract.

The second attachment mechanism 25 may be structured similarly to the first attachment mechanism 23. For instance, the second post 10 that extends from the intermediate member to the top member may include a second rotatable plate 40 to which a second slideability mechanism 33 is attached. In some embodiments, it is contemplated that the second post 10 may be attached to the first rail 41. In other embodiments, the second post 10 may be connected within the intermediate member 4 to different structure located in the intermediate member 4.

The second slideability mechanism 33 may include a second guide member 61 or second carriage having a second opening 63 that is sized to receive a second rail 45 that is slideable through the opening 63 to linearly move or slide the top member 6. The second rail 45 may be moved through the second opening 63 while the second guide member 61 does not move to effect a linear movement of the top member. A second detent mechanism 91 may be connected to the second guide member.

The second detent mechanism may be configured to releasably lock the second rail 45 to the second guide member 61. An actuator such as a button, lever, or knob may be attached to the top member 6, intermediate member 4, or base 2 and be coupled to the second detent mechanism 91 to cause a detent member of the detent mechanism to move to an unlocked position so that the top member may be moved linearly to a new position. A plurality of holes may be formed on the second rail 45 to define different positions along which the top member may be moved linearly. In other embodiments, no detent mechanism may be provided and the linear position of the intermediate position may be maintained via a predetermined level of friction that may be induced between the second rail 45 and the second guide member 61 that requires force from a user to be provided to cause linear movement of the top member 6 via movement of the second rail 45 through the second aperture 63. As yet another alternative, an infinite position lock mechanism may be utilized to maintain a position of the intermediate member instead of a detent mechanism.

The second guide 61, second aperture 63 and second rail 45 may be sized, shaped, and otherwise configured so that a force needed for linear movement of the top member is less than the force needed for moving the intermediate member. Such differing frictional inducement levels that result in different force levels being required may permit the top member 6 to be moved linearly independently of the intermediate member so that the top member 6 may be slid while the intermediate member is maintained in its original position or is otherwise not moved via sliding of the top member 6.

The second rotatable plate 40 attached to the second post 10 may be rotatable about 360° or less than 360°. For instance, the second rotatable plate 40 could have an extent of rotation such as a 180° or 90° extent of rotational travel. A detent mechanism may be configured to define the extent to which the second rotatable plate 40 is rotatable or to releasably lock the second rotatable plate into a user selected position. If a detent mechanism is included, an actuator that a user may manipulate to control the locking or unlocking of a detent member may be attached to the coffee table and to a detent member of the detent mechanism to move the detent member into an unlocked position for rotating the intermediate member via the second rotatable plate 40. A structure such as a portion of the top member 6 or a portion of the second rotatable plate 40 may have one or more openings sized to receive the moveable detent member for releasably locking the position of the second rotatable plate. The detent member may be connected to the other of a structure of the top member or portion of the second rotatable plate 40. The openings that may define different positions in which the top member 6 may be releasably locked in may be defined by the arrangement of the openings. The openings may be spaced 5-10° apart or up to 20°, 30°, 45° or 60° apart along a path of travel that extends 90°, 180° or 260° for example.

The detent member may be connected to a spring to bias the detent member to a locked position. The spring to which the detent member is connected may be positioned between an actuator and the detent member.

As an alternative to a detent mechanism for prevent undesired rotation of the top member 6, a locking device or an infinite position locking device may be utilized to prevent undesired rotation of the top member. A locking device may lock the position by preventing rotation of the second rotatable plate 40 unless the locking device is adjusted to an unlocked position. As another alternative, the second rotatable plate 40 may be attached to the second post 10 such that a relatively high force is needed to be provided by a user to effect rotation due to friction that is induced by components attached to the second post 10 and that contact the second rotatable plate 40 that induce friction that must be overcome to drive rotation of the second rotatable plate 40.

Dampening mechanisms 101 and 103 may also be connected to the second slide mechanism 33 and second rotatable plate 40 to ensure a force above a predetermined amount of force is needed to be applied to cause sliding or rotation of the intermediate member and also ensure that the movement of the intermediate member occurs within a predetermined rate of speed to avoid both accidental movement of the top member 6 and unsafe instability that may be induced by high speeds of movement of the top member 6. Instability may be caused by a high speed of the top member that could cause an object supported by top member 6 to fall over or to cause the base 2 of the coffee table to move in an undesired way (e.g. tilt or slide along a floor when a user does not intend for this to occur, etc.).

At least one third dampening mechanism 203 may be connected to the second rotatable plate 40 and be configured to regulate the speed at which the second rotatable plate 40 may rotate. A plurality of dashpots or other damper elements may be connected to the second rotatable plate to provide such dampening. For instance, a first dashpot may have an extendable arm or base pivotally connected to the intermediate member or top member adjacent a first side of the second rotatable plate and a second dashpot may have its extendable arm or receptacle member pivotally connected to the intermediate member 4 or top member 6 on a second side of the second rotatable plate that is opposite the first dashpot. A respective gear, a respective gear of a plurality of intermeshed gears, or a connector that may rotate when the second rotatable plate 40 rotates may be attached or immovably affixed to each dashpot so that rotation of the second rotatable plate 40 cause the extendable arm of the dashpot to extend or retract via the coupling of the dashpot to the second rotatable plate. The gear or connector to which each dashpot is connected may be configured to rotate at a different ratio than the second rotatable plate to cause extension and retraction of the dashpots to occur at a desired rate that corresponds to rotation of the second rotatable plate 40. The size, strength, and force exerted by the dashpots may be configured to define a desired level of force needed to rotate the top member 6 and also ensure that rotation of the top member 6 only occurs within a preselected rate of rotation.

At least one fourth dampening mechanism 201 may be connected to the second rail 45 to help regulate the speed at which the top member 6 may be moved. The second dampening mechanism may include a looped chain or cable that extends between two pulleys at a given level of tension such that movement of the second rail 45 causes the looped chain or cable to move. The friction or force provided via the looped chain may prevent sliding of the second rail 45 to occur at an undesired rate of speed. A rotary damper or dashpot may be connected to at least one of the pulleys to help regulate how quickly the chain or cable may pass along the pulleys during linear movement of the top member 6 to help regulate the speed at which linear movement of the top member may occur. Alternatively, dashpots may be coupled to opposite ends of the second rail 45 so that sliding of the rail in one direction within the second aperture 12 causes one dashpot's moveable arm to extend and the other dashpot's moveable arm to retract.

It should be appreciated that the first rotatable plate 30 may be attached to the first post 8 so that a different level of force is needed to rotate the first rotatable plate as compared to a force needed for rotation of the second rotatable plate 40 attached to the second post 10. For example, it may be desired to permit the top member 6 to be rotated without the intermediate member 4 being rotated. The first rotatable plate 30 may therefore be moveably attached to the first post 8 so that a greater amount of force is needed for rotating the first rotatable plate 30 and the intermediate member 4 as compared to the force needed for rotating the second rotatable plate 40 attached to the second post 10. The different amounts of force may differ substantially (e.g. by at least 5-25%) to permit the top member 6 to be rotated independently of the intermediate member 4 so that the top member may be rotated while the intermediate member does not rotate.

It should be understood that the base 2, intermediate member 4 and top member 6 may each have any of a number of shapes, sizes and material compositions to meet a particular set of design criteria. For instance, the top member and intermediate member may each include a glass housing or a glass top portion that is attached to a frame. As another example, the top and intermediate members 6, 4 may be constructed from a wood or have a wood housing that is attached to a frame and encases portions of the adjustability mechanism. The base 2 may include a frame that is attached to a housing that encases the frame. The housing of the base 2 may be made of wood, glass, a metal, a composite material, or other material.

Therefore it should be understood that while certain present preferred articles of furniture and methods of making and using the same have been discussed and illustrated herein, it is to be distinctly understood that the invention is not limited thereto but may be otherwise variously embodied and practiced within the scope of the following claims.

What is claimed is:

1. An article of furniture comprising:

a base;

an intermediate member positioned above the base;

a top member positioned above the intermediate member; and an adjustability mechanism that is attached to the base, the intermediate member, and the top member such that the intermediate member and the top member are each moveable relative to the base and such that the intermediate member is moveable relative to the top member and the top member is moveable relative to the intermediate member;

wherein the adjustability mechanism comprises:

a first post and a second post;

the first post attached to the base and extending into at least one first aperture of the intermediate member, the first post and the at least one first aperture of the intermediate member defining a path of movement along which the intermediate member is moveable relative to the base;

the second post attached to the intermediate member and extending into at least one second aperture of the top member, the second post and the at least one second aperture of the top member defining a path of movement along which the top member is moveable relative to the intermediate member; and wherein the at least one first aperture is comprised of a plurality of slots and the at least one second aperture is comprised of a plurality of slots.

2. An article of furniture comprising:

a base;

an intermediate member positioned above the base;

a top member positioned above the intermediate member; and an adjustability mechanism that is attached to the base, the intermediate member, and the top member such that the intermediate member and the top member are each moveable relative to the base and such that the intermediate member is moveable relative to the top member and the top member is moveable relative to the intermediate member;

wherein the adjustability mechanism comprises:

a first post and a second post;

the first post attached to the base and extending into at least one first aperture of the intermediate member, the first post and the at least one first aperture of the intermediate member defining a path of movement along which the intermediate member is moveable relative to the base;

the second post attached to the intermediate member and extending into at least one second aperture of the top member, the second post and the at least one second aperture of the top member defining a path of movement along which the top member is moveable relative to the intermediate member; and wherein the adjustability mechanism is further comprised of a first friction inducing member and a second friction inducing member, the first friction inducing member is attached to the first post and contacts a portion of the intermediate member adjacent the at least one first aperture such that the first friction inducing member induces friction when the intermediate member moves relative to the base, the second friction inducing member is attached to the second post and contacts a portion of the top member adjacent the at least one second aperture such that the second friction inducing member induces friction when the top member moves relative to the base.

3. The article of claim 2 wherein the adjustability mechanism is connected to at least one of the intermediate member and the top member such that movement of the top member is independent of movement of the intermediate member.

4. The article of claim 2 wherein the adjustability mechanism also comprises:

a first rotatable plate attached to the first post and a first rail that is movable linearly within the intermediate member relative to the first rotatable plate;

a second rotatable plate attached to the second post; and a second rail that is moveable linearly within the top member relative to the second rotatable plate;

a first guide member that is positionable adjacent the first rail; and a second guide member that is positionable adjacent the second rail.

5. The article of claim 4 wherein the first guide member is attached to the first rotatable plate and the first rail is slideable through an opening of the first guide member and the second guide member is attached to the second rotatable plate and the second rail is slideable through an opening of the second guide member.

6. The article of furniture of claim 2 wherein the top member slides along a top surface of the intermediate member when the top member is moved and the intermediate member slides along a top surface of the base when the intermediate member is moved.

7. The article of furniture of claim 2 wherein the top member is spaced apart from the intermediate member by a first gap and the intermediate member is spaced apart from the base by a second gap.

8. An article of furniture comprising:

a base;

an intermediate member positioned above the base;

a top member positioned above the intermediate member; and an adjustability mechanism that is attached to the base, the intermediate member, and the top member such that the intermediate member and the top member are each moveable relative to the base and such that the intermediate member is moveable relative to the top member and the top member is moveable relative to the intermediate member; and wherein the adjustability mechanism comprises:

a first post;

the first post attached to the base and extending through at least one first aperture of the intermediate member and into at least one second aperture of the top member;

the first post and the at least one first aperture of the intermediate member defining a path of movement along which the intermediate member is moveable relative to the base;

the first post and the at least one second aperture of the top member defining a path of movement along which the top member is moveable relative to the intermediate member.

9. The article of furniture of claim 8 wherein the adjustability mechanism is further comprised of a first friction inducing member and a second friction inducing member, the first friction inducing member is attached to the first post and contacts a portion of the intermediate member adjacent the at least one first aperture such that the first friction inducing member induces friction when the intermediate member moves relative to the base, the second friction inducing member is attached to the first post and contacts a portion of the top member adjacent the at least one second aperture such that the second friction inducing member induces friction when the top member moves relative to the base.

10. The article of furniture of claim 8 wherein the article is a coffee table, a counter, a tabletop or an end table.

11. An article of furniture comprising:

a base;

an intermediate member positioned above the base;

a top member positioned above the intermediate member; and an adjustability mechanism, the adjustability mechanism comprising:

a first post and a second post;

the first post attached to the base and extending into at least one first aperture of the intermediate member, the first post and the at least one first aperture of the intermediate member defining a path of movement along which the intermediate member is moveable relative to the base;

the second post attached to the intermediate member and extending into at least one second aperture of the top member, the second post and the at least one second aperture of the top member defining a path of movement along which the top member is moveable relative to the intermediate member; and wherein the at least one first aperture is comprised of a plurality of slots and the at least one second aperture is comprised of a plurality of slots.

12. An article of furniture comprising:

a base;

an intermediate member positioned above the base;

a top member positioned above the intermediate member; and an adjustability mechanism, the adjustability mechanism comprising:

a first post and a second post;

the first post attached to the base and extending into at least one first aperture of the intermediate member, the first post and the at least one first aperture of the intermediate member defining a path of movement along which the intermediate member is moveable relative to the base;

the second post attached to the intermediate member and extending into at least one second aperture of the top member, the second post and the at least one second aperture of the top member defining a path of movement along which the top member is moveable relative to the intermediate member; and wherein the adjustability mechanism is further comprised of a first friction inducing member and a second friction inducing member, the first friction inducing member is attached to the first post and contacts a portion of the intermediate member adjacent the at least one first aperture such that the first friction inducing member induces friction when the intermediate member moves relative to the base, the second friction inducing member is attached to the second post and contacts a portion of the top member adjacent the at least one second aperture such that the second friction inducing member induces friction when the top member moves relative to the base.

13. The article of furniture of claim 12 wherein the article is a coffee table, a counter, or an end table.

14. The article of furniture of claim 12 wherein the top member slides along a top surface of the intermediate member when the top member is moved and the intermediate member slides along a top surface of the base when the intermediate member is moved.

15. The article of furniture of claim 12 wherein the top member is spaced apart from the intermediate member by a first gap and the intermediate member is spaced apart from the base by a second gap.

16. An article of furniture comprising:

a base;

an intermediate member positioned above the base;

a top member positioned above the intermediate member; and an adjustability mechanism, the adjustability mechanism comprising:

a first post and a second post;

the first post attached to the base and extending into at least one first aperture of the intermediate member, the first post and the at least one first aperture of the intermediate member defining a path of movement along which the intermediate member is moveable relative to the base;

the second post attached to the intermediate member and extending into at least one second aperture of the top member, the second post and the at least one second aperture of the top member defining a path of movement along which the top member is moveable relative to the intermediate member; and wherein the adjustability mechanism also comprises:

a first rotatable plate attached to the first post and a first rail that is movable linearly within the intermediate member relative to the first rotatable plate;

a second rotatable plate attached to the second post; and a second rail that is moveable linearly within the top member relative to the second rotatable plate.

17. The article of furniture of claim 16, wherein the adjustability mechanism also comprises:

a first guide member that is positionable adjacent the first rail and a first detent mechanism that is attached to the first guide member to releaseably lock the first rail to the first guide member;

a second guide member that is positionable adjacent the second rail and a second detent mechanism that is attached to the second guide member to releaseably lock the second rail to the second guide member.

18. The article of furniture of claim 17 wherein the adjustability mechanism further comprises:

at least one first dampening mechanism attached to the first rotatable plate; and at least one second dampening mechanism attached to the first rail.

19. The article of claim 18 wherein the adjustability mechanism further comprises:

at least one third dampening mechanism attached to the second rotatable plate; and at least one fourth dampening mechanism attached to the second rail.

20. The article of claim 17 wherein the first guide member is attached to the first rotatable plate and the first rail is slideable through an opening of the first guide member and the second guide member is attached to the second rotatable plate and the second rail is slideable through an opening of the second guide member.

* * * * *